US006776152B2

(12) United States Patent
Lee

(10) Patent No.: US 6,776,152 B2
(45) Date of Patent: Aug. 17, 2004

(54) RANGE HOOD

(76) Inventor: Hak Ju Lee, Hyundai Apt., 102-604, Gaishin-Dong, Heungdeok-Gu, Cheongju-City, Chungcheongbuk-Do, 361-751 (KR)

( * ) Notice: Subject to any disclaimer, the term of this patent is extended or adjusted under 35 U.S.C. 154(b) by 0 days.

(21) Appl. No.: 10/380,321

(22) PCT Filed: Sep. 6, 2001

(86) PCT No.: PCT/KR01/01505

§ 371 (c)(1),
(2), (4) Date: Sep. 23, 2003

(87) PCT Pub. No.: WO02/23097

PCT Pub. Date: Mar. 21, 2002

(65) Prior Publication Data

US 2004/0107956 A1 Jun. 10, 2004

(30) Foreign Application Priority Data

Sep. 14, 2000 (KR) ..... 2000-25868

(51) Int. Cl.[7] ..... F24B 13/00
(52) U.S. Cl. ..... 126/299 R; 126/299 D
(58) Field of Search ..... 126/299 R, 299 D, 126/302; 454/49

(56) References Cited

U.S. PATENT DOCUMENTS 4,827,903 A * 5/1989 Kim ..... 126/299 R
5,205,279 A * 4/1993 Brown ..... 126/299 R

FOREIGN PATENT DOCUMENTS

| | | |
|---|---|---|
| JP | 06-000314 A | 1/1994 |
| JP | 06-126118 A | 5/1994 |
| JP | 10-054598 A | 2/1998 |
| JP | 10-197022 A | 7/1998 |

* cited by examiner

*Primary Examiner*—Alfred Basichas
(74) *Attorney, Agent, or Firm*—Birch, Stewart, Kolasch & Birch, LLP

(57) ABSTRACT

The object of this invention is to provide a range hood. The hood body (20) of the range hood consists of a lower plate (22) having perforations for sucking air from the kitchen into the hood body, with an inward locking flange (23, 23') formed along the top edge of each sidewall of the lower plate. Two guide panels (21, 21'), each having a locking part, are assembled with the lower plate (22) by an engagement of their locking parts with the inward locking flanges. A double absorption filter (30) is installed inside the hood body so as to remove oil, dust and other impurities from exhaust air by means of an air vortex effect. The range hood also has a hood cover (10), an exhaust duct (11), a fan motor (13), an exhaust fan (12), and a ventilation duct (14) to discharge exhaust air to the atmosphere.

6 Claims, 2 Drawing Sheets

RANGE HOOD

This application is the national phase under 35 U.S.C. § 371 of PCT International Application No. PCT/KR01/01505 which has an International filing date of Sep. 6, 2001, which designated the United States of America.

TECHNICAL FIELD

The present invention relates, in general to a range hood installed in a kitchen of houses or restaurants at a position above a cooker, such as an electronic range, for accomplishing ventilation of the kitchen and, more particularly, to a range hood using a double absorption filter capable of quickly and smoothly exhausting contaminated air along with odors from the kitchen to the atmosphere while effectively removing oil, dust and other impurities from the exhaust air through absorption, the range hood being also designed to be usable for a desired lengthy period of time.

BACKGROUND ART

As well known to those skilled in the art, a range hood is installed in a kitchen at a position above a cooker, such as an electronic range, for smoothly exhausting contaminated air mixed with oil-laden steam generated from food and gas generated from the cooker during a cooking process. In a conventional range hood, a filter is installed in a hood body communicating with a ventilation duct installed in the ceiling of a kitchen, and removes oil, dust and other impurities from exhaust air.

However, such a conventional range hood is problematic in that oil, dust and other impurities are gradually deposited on the filter as time goes by to spoil the appearance of the hood and reduce the operational function of the filter, thus finally forcing a user to change the existing filter with a new one. The conventional range hood is thus inconvenient to the user and forces the user to pay excessive money to maintain and repair it.

Korean Utility Model Laid-open Publication No. 99-16329 discloses a range hood filter for electronic ranges, which is installed at a predetermined position inside-an-exhaust air passage defined between a twin fan and a front grille of an electronic range, with front and rear exhaust guiders respectively arranged on the surfaces of front and rear metal nets of a filter body such that the exhaust guiders cross each other.

Korean Utility Model Laid-open Publication No. 99-25920 discloses a device for detachably attaching a filter guard in range hoods. In this device, an insert pin is integrally formed at each side of the rear end of a filter guard, while a guide hole is formed on the internal surface of each sidewall of a hood body. The filter guard is thus detachably attached to the hood body by inserting the insert pins of the guard into the guide holes of the hood body.

Korean Patent Publication No. 144621 discloses a range hood, consisting of a hood body, an exhaust guide drum, a filter, a water tray, an overflow pipe, and a feed pipe. In the range hood, the hood body is arranged on the ceiling of a kitchen to communicate with a ventilation duct, while the exhaust guide drum is fixed on the lower surface of an upper plate provided in the hood body. The guide drum also has a plurality of slits forming air passages by their opposite sidewalls which are inclined to gradually reduce the width of the passages in a direction from the top to the bottom The filter is installed inside the exhaust guide drum, while the water tray is installed at a position under the guide drum. The overflow pipe is installed such that its top end is aligned with the water level inside the water tray. The feed pipe is used for feeding organic separation water to the water tray and maintaining a predetermined water level inside the water tray.

However, such conventional range hoods are problematic in that they fail to smoothly, easily, quickly or effectively remove oil, dust, odors or other impurities from air inside the kitchen. The filters used in the conventional range hoods must be frequently cleaned or changed with new ones since it is impossible to use the filters for a desired lengthy period of time without cleaning or changing the filters. The conventional range hoods are thus inconvenient to users.

DISCLOSURE OF THE INVENTION

Accordingly, the present invention has been-made keeping in mind the above problems occurring in the prior art, and an object of the present invention is to provide a range hood for home use or restaurant use, which uses a double absorption filter that has been typically used for industrial applications, and which thus quickly and smoothly exhausts contaminated air along with odors from a kitchen to the atmosphere while effectively removing oil, dust and other impurities from the exhaust air, and which is usable for a desired lengthy period of time.

In order to accomplish the above object, the present invention provides a range hood using a double absorption filter disclosed in Korean Patent registration No. 238993 applied by and allowed to the inventor of this invention. The range hood of this invention consists of a lower plate, having a plurality of perforations and an inward locking flange formed along the top edge of each sidewall thereof Two guide panels, each having a locking part with a U-shaped cross-section, are assembled with the lower plate by an engagement of their locking parts with the inward locking flanges of the lower plate, thus forming a hood body. A double absorption filter having a collapsible bellows structure is installed inside the hood body, with a plurality of supporters mounted to the guide panels to maintain the filter inside the hood body and prevent the filter from being undesirably removed from the hood body. The top of the hood body is covered with a hood cover, while an exhaust duct extends upward from the top of the hood cover. A fan motor is installed on the top of the exhaust duct, and an exhaust fan is installed inside the top of the exhaust duct and is operated in conjunction with the fan motor to form a suction force inside the hood body. A ventilation duct extends from the top of the exhaust duct to discharge air from the hood body to the atmosphere.

In the range hood, the double absorption filter is formed by a parallel integration of a plurality of longitudinal hollow bodies, each of which is made of thick paper and has an inverted triangular cross-section, with a longitudinal top wall of each hollow body bent downward along its central axis to form a V-shaped cross-section. A plurality of top holes having a circular profile are formed on the top wall of each hollow body of the filter along the central axis, while a plurality of side holes having a circular profile are formed on one sidewall of each hollow body of the filter in such a way that-the side holes are not directly aligned with the top holes, but are alternately arranged relative to the top holes to form a zigzag arrangement of holes. Liquid-phase impurities laden in exhaust air, introduced into the interior of the filter through the side holes, are thus not discharged from the filter through the top holes, but are dropped to the acute bottom of the interior of the filter so as to be collected on the bottom In the range hood of this invention, the filter is made of a fire resistant thick paper, which is impregnated with a fire retardant and is produced through a conventional paper producing process. The filter is formed by a parallel integration of a plurality of longitudinal hollow bodies each made of the thick paper and having an inverted triangular cross-section. The filter has a collapsible bellows structure, thus being extended or collapsed as desired. Due to the filter installed in the hood body, the range hood of this invention quickly and smoothly exhausts contaminated air along with odors from a kitchen while removing oil, dust and other impurities from the exhaust air.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
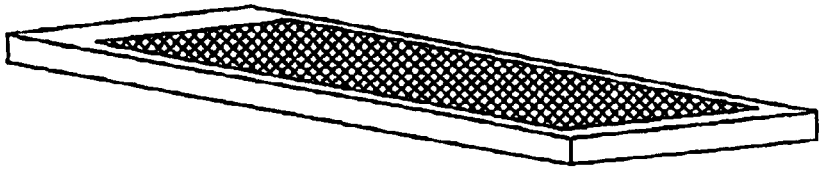
FIG. 1 is a perspective view of a conventional filter for range hoods.

Reference now should be made to the drawings, in which the same reference numerals are used throughout the different drawings to designate the same or similar components.

Figure 2:
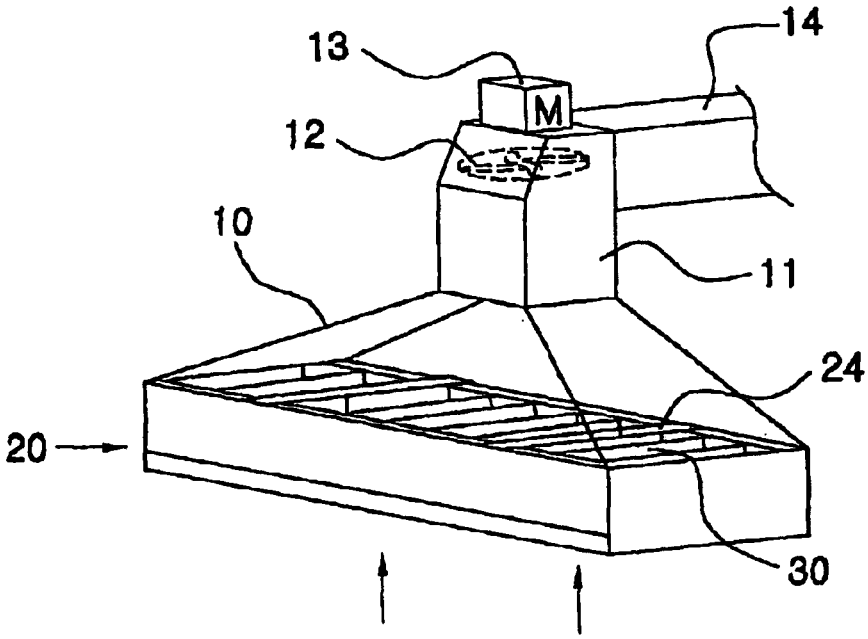
FIG. 2 is a perspective view of a range hood in accordance with the preferred embodiment of the present invention.
Figure 3:
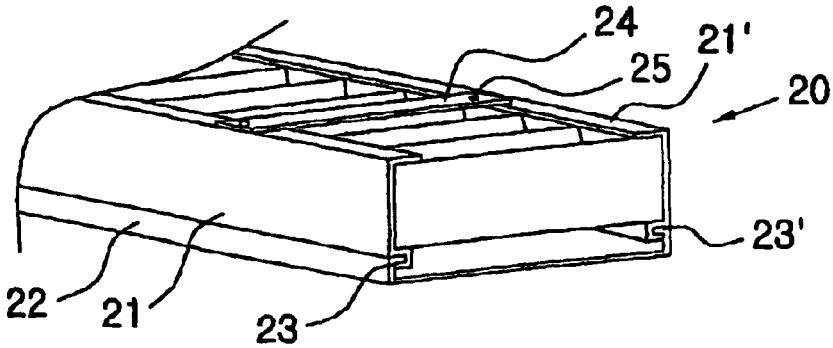
FIG. 3 is a sectional perspective view of the range hood of the present invention.
Figure 4:
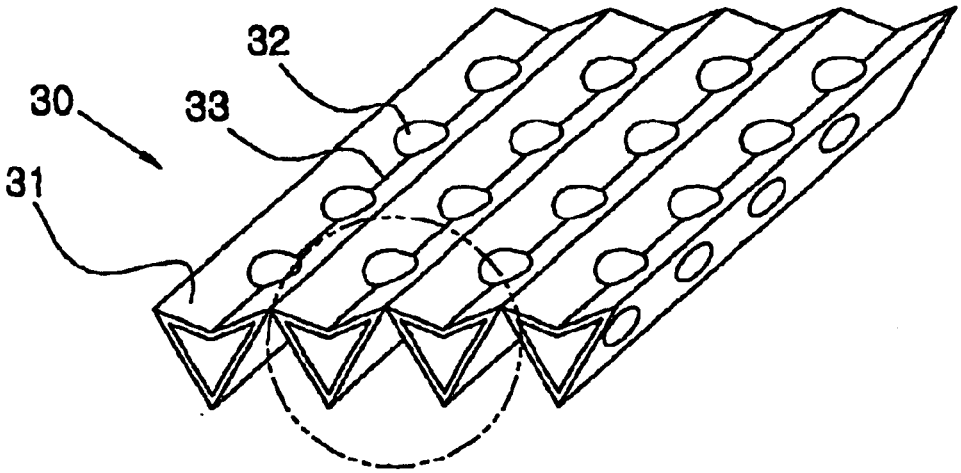
FIG. 4 is a perspective view of a double absorption filter used in the range hood of the present invention.

FIG. 1 is a perspective view of a filter for conventional range hoods. FIG. 2 is a perspective view of a range hood in accordance with the preferred embodiment of the present invention. FIG. 3 is a sectional perspective view of the range hood of the present invention. FIG. 4 is a perspective view of a filter used in the range hood of the present invention FIG. 5 is a sectional view of the filter used in the range hood of the present invention.

The range hood of this invention has a hood body 20. The hood body 20 has a lower plate 22 with a plurality of perforations as shown in FIGS. 2 and 3. Two inward locking flanges 23 and 23' are formed along the top edges of the opposite sidewalls of the lower plate 22, with two guide panels 21 and 21' assembled with the two sidewalls of the lower plate 22. In order to accomplish the assemblage of the lower plate 22 with the guide panels 21 and 21', the lower edges of the two guide panels 21 and 21' are bent to form two locking rails having a U-shaped cross-section, and engage with the two locking flanges 23 and 23' of the lower plate 22 at the locking rails, thus forming a desired hood body. A double absorption filter 30 is installed inside the hood body 20 at the gap between the two guide panels 21 and 21'. The filter 30 has a bellows structure, and so it is extended or collapsed as desired. Two or three supporters 24 transversely extend between the two guide panels 21 and 21', and are mounted to the top edges of the panels 21 and 21' using a plurality of set screws 25, thus preventing the filter 30 from being undesirably removed from the hood body 20. The top of the hood body 20 is covered with a hood cover 10, with an exhaust duct 11 extending upward from the top of the hood cover 10. A fan motor 13 is installed on the top of the exhaust duct 11, with an exhaust fan 12 positioned inside the top portion of the exhaust duct 11 and operated in conjunction with the motor 13. A ventilation duct 14 extends from the top portion of the exhaust duct 11, and so contaminated air along with odors from a kitchen is sucked into the ventilation duct 14 by the suction force of the fan 12 prior to being discharged to the atmosphere.

Figure 5:
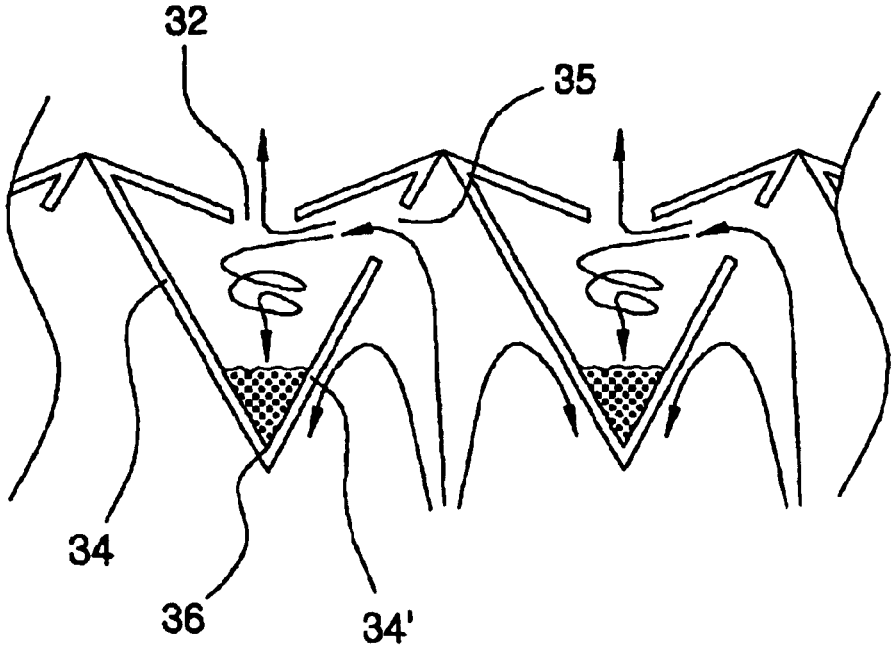
FIG. 5 is a sectional view of the filter used in the range hood of the present invention.

The construction and operation of the double absorption filter 30 is shown in FIGS. 4 and 5 in more detail. As shown in the drawings, the filter 30 is formed by a parallel integration of a plurality of longitudinal hollow bodies each made of thick paper and having an inverted-triangular cross-section, with the longitudinal top wall 31 of each hollow body of the filter 30 bent downward along its central axis 33 to form a V-shaped cross-section. A plurality of top holes 32, having a circular profile, are regularly formed on the top wall 31 along the central axis 33. A plurality of side holes 35 having a circular profile are regularly formed on one sidewall 34' of each hollow body of the filter 30 in such a way that the side holes 35 are not directly aligned with the top holes 32, but are somewhat alternately arranged relative to the top holes 32 to form a zigzag arrangement of holes 32 and 35. Due to the zigzag arrangement of the two rows of holes 32 and 35, liquid-phase impurities laden in exhaust air introduced into the interior of the filter 30 through the side holes 35 are not discharged from the filter 30 through the top holes 32, but are dropped to the acute bottom 36 of the interior of the filter 30 so as to be collected on the bottom 36.

As shown in FIGS. 4 and 5, the three points of the triangular cross-section of each hollow body of the filter 30 form the points of a regular triangle. Due to the regular triangular structure, the filter 30 forms an air vortex effect inside its interior even though it is made of thick paper, and so the operational effect of the filter 30 is enhanced.

In the present invention, the filter 30 is made of a fire resistant material impregnated with a fire retardant such as salt, and so it is possible to almost completely prevent a fire breaking out at the filter 30 regardless of excessive heat around the hood. The production of the filter 30 using such a fire resistant material also enhances the heat dissipating effect, heat insulation effect and electric insulation effect of the filter 30.

In addition, the filter 30 of this invention may be added with a ceramic material on its external surface to accomplish a desired antibacterial activity.

In order to ventilate a kitchen using the range hood of this invention the hood is turned on to start the fan motor 13. The fan 12 is thus rotated by the motor 13, and generates suction force inside the range hood. Contaminated air laden with oil, dust and other impurities in addition to odors is sucked from the kitchen into the hood body 20 through the perforations of the lower plate 22, and is introduced into the filter 30. In such a case, the sucked air flows upward along the external surfaces of the sidewalls 34' of the filter 30 prior to flowing into the interior of the filter 30 through the side holes 35. Inside the filter 30, the sucked air swirls prior to flowing from the filter 30 through the top holes 32, while oil, dust and other impurities heavier than air come into contact with the internal surface of the sidewalls 34 and 34' of the filter 30 and are dropped to the acute bottom 36 of the sidewalls 34 and 34' of the filter 30. The oil, dust and other impurities are thus adhered to the surface of the bottom 36. The air free from such heavier oil, dust or other impurities flows from the filter 30 along with odors is through the top holes 32,; and sequentially passes through the interior of the hood cover 10, the exhaust duct 11 and the ventilation duct 14 prior to being quickly discharged to the atmosphere.

INDUSTRIAL APPLICABILITY

As described above, the present invention provides a range hood using a double absorption filter. The range hood quickly and smoothly sucks air contaminated with oil, dust and other impurities in addition to odors from a kitchen, and discharges air along with the odors to the atmosphere after removing the oil, dust and other impurities from the air by the absorption filter having a regular triangular cross-sectional structure creating an air vortex effect. The filter used in the range hood of this invention is also made of a material capable of increasing the heat insulation effect, electric insulation effect, fire resisting effect and structural strength of the filter, and so the range hood of this invention is usable for a desired lengthy period of time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A range hood installed at a position above a cooker in a kitchen to ventilate the kitchen, comprising:

a hood body consisting of:

a lower plate having a plurality of perforations for sucking air laden with oil, dust and odors from the kitchen into the hood body, with an inward locking flange foamed along a top edge of each sidewall of the lower plate; and two guide panels each having a locking part with a U-shaped cross-section and assembled with the lower plate by an engagement of their locking parts with the inward locking flanges of the lower plate;

a filter installed inside said hood body;

a plurality of supporters mounted to said guide panels to maintain the filter inside the hood body and preventing the filter from being undesirably removed from the hood body;

a hood cover covering the top of the hood body;

an exhaust duct extending from the top of said hood cover;

a fan motor installed on the top of said exhaust duct;

an exhaust fan installed inside the top of said exhaust duct and operated in conjunction with the fan motor to form a suction force inside the hood body; and a ventilation duct extending from the top of the exhaust duct to discharge air from the hood body to the atmosphere.

2. The range hood according to claim 1, wherein said filter is a double absorption filter formed by a parallel integration of a plurality of longitudinal hollow bodies each made of thick paper and having an inverted triangular cross-section, with a longitudinal top wall of each of the hollow bodies of said filter bent downward along its central axis to form a V-shaped cross-section, a plurality of circular top holes formed on said top wall of each hollow body of the filter along the central axis, a plurality of circular side holes formed on one sidewall of each hollow body of the filter in such a way that the side holes are not directly aligned with said top holes, but are alternately arranged relative to the top holes to form a zigzag arrangement of holes, and so impurities, such as oil and dust, laden in exhaust air introduced into the interior of the filter are not discharged from the filter through the top holes, but are dropped to an acute bottom of the interior of the filter while swirling so as to be collected on said bottom.

3. The range hood according to claim 1 or 2, wherein the material of said filter is impregnated with a fire retardant.

4. The range hood according to claim 3, wherein said fire retardant impregnated in the filter is salt.

5. The range hood according to claim 1 or 2, wherein said filter is processed to have an antibacterial activity.

6. The range hood according to claim 5, wherein said antibacterial activity of the filter is accomplished by an addition of a ceramic material to the filter.

* * * * *